US010968622B2

(12) United States Patent
Klein

(10) Patent No.: US 10,968,622 B2
(45) Date of Patent: Apr. 6, 2021

(54) EXPANDABLE SAFE ROOM

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 15/540,481

(22) PCT Filed: Jun. 8, 2016

(86) PCT No.: PCT/IL2016/050594
§ 371 (c)(1),
(2) Date: Jun. 28, 2017

(87) PCT Pub. No.: WO2016/199136
PCT Pub. Date: Dec. 15, 2016

(65) Prior Publication Data

US 2017/0314255 A1 Nov. 2, 2017

(30) Foreign Application Priority Data

Jun. 8, 2015 (IL) ..... 239282

(51) Int. Cl.

| | |
|---|---|
| ***E04B 1/344*** | (2006.01) |
| ***E04H 9/02*** | (2006.01) |
| ***E04H 9/10*** | (2006.01) |
| ***E04B 1/343*** | (2006.01) |
| ***E04H 9/06*** | (2006.01) |
| *E04B 1/98* | (2006.01) |

(52) U.S. Cl.
CPC ..... *E04B 1/3445* (2013.01); *E04B 1/3444* (2013.01); *E04B 1/34357* (2013.01); *E04H 9/028* (2013.01); *E04H 9/06* (2013.01); *E04H 9/10* (2013.01); *E04B 1/98* (2013.01)

(58) Field of Classification Search
CPC ..... E04B 1/98; E04B 1/3445; E04B 1/34357; E04B 1/344; E04B 1/3442; E04B 1/3448; E04B 1/3444; E04B 1/92; E04B 1/34384; E04B 1/3447; E04H 9/06; E04H 15/46; E04H 15/48; E04H 9/04; E04H 9/10; Y10S 135/904; F41H 5/24
USPC ..... 52/79.1
See application file for complete search history.

(56) References Cited

U.S. PATENT DOCUMENTS 3,257,760 A 6/1966 Calthorpe
3,629,982 A * 12/1971 Ballay ..... E04B 1/3444 52/69

(Continued)

FOREIGN PATENT DOCUMENTS

JP S6198838 A 5/1986
JP H07294197 A 11/1995

(Continued)

*Primary Examiner* — Brian E Glessner
*Assistant Examiner* — James Buckle, Jr.
(74) *Attorney, Agent, or Firm* — William Dippert; Laurence Greenberg; Werner Stemer

(57) ABSTRACT

An expandable safe room (ESR) defining a protected space therein is provided and comprises a main upright frame, a pair of side walls hingedly connected to the main upright frame, and a front wall parallel to the main upright frame and hingedly connected to the side walls, wherein deploying the ESR in an expanding direction moves the front wall in a forward direction and away from the main upright frame. Floor and roof are also provided wherein the deployment of the ESR can be automatically or manually.

16 Claims, 5 Drawing Sheets

(56) References Cited

U.S. PATENT DOCUMENTS 3,827,198 A * 8/1974 Geihl ..... E04B 1/3442 52/69
3,866,365 A * 2/1975 Honigman ..... E04B 1/3444 52/66
4,035,964 A * 7/1977 Robinson ..... E04B 1/3445 217/14
4,037,385 A * 7/1977 Wahlquist ..... E04B 1/3445 52/39
4,989,379 A * 2/1991 Suzuki ..... E04B 1/3442 52/66
5,345,730 A 9/1994 Jurgensen
5,392,686 A 2/1995 Sankar
5,493,818 A * 2/1996 Wilson ..... E04B 1/3445 52/71
7,856,762 B2 * 12/2010 Deisenroth ..... B60N 2/4242 52/143
8,978,318 B2 3/2015 Klein
9,976,306 B1 * 5/2018 Horner ..... E04C 3/36
2005/0066588 A1 * 3/2005 Stapleton, Jr. ..... E04B 1/3445 52/79.1
2006/0080897 A1 * 4/2006 O'Neal ..... E04H 9/10 52/1
2007/0180981 A1 8/2007 Tapp et al.
2014/0202088 A1 7/2014 Nakajima et al.
2014/0202089 A1 * 7/2014 Nakajima ..... E04B 1/3444 52/79.5
2014/0311051 A1 10/2014 Fagan et al.
2015/0075073 A1 * 3/2015 Sylvester ..... E05G 5/003 49/24
2016/0102471 A1 * 4/2016 Grieves ..... B32B 9/045 428/215
2017/0159316 A1 * 6/2017 Soukos ..... E04H 9/029
2018/0245886 A1 * 8/2018 Goodson ..... F41H 5/0428
2018/0292182 A1 * 10/2018 Sprague ..... F41H 5/04
2019/0113311 A1 * 4/2019 Zehnter ..... F41H 5/04
2019/0153741 A1 * 5/2019 Monk ..... E04B 1/98

FOREIGN PATENT DOCUMENTS

JP 2005241183 A 9/2005
JP 4898309 B2 3/2012
JP 5564138 B1 7/2014

* cited by examiner

EXPANDABLE SAFE ROOM

CROSS-REFERENCE TO RELATED APPLICATIONS

This application is a National Phase filing under 35 U.S.C. § 371 of International Patent Application No. PCT/IL2016/050594, filed Jun. 8, 2016, which is based upon and claims the benefit of the priority date of Israeli Patent Application No. 239282, filed Jun. 8, 2015, each of which is incorporated herein by reference.

TECHNICAL FIELD

The present disclosure relates to the field of protective structures, and more particularly to the field of expandable protective structures.

BACKGROUND

Protective structures are known. Typically, the protective structures are made of steel and are capable of protecting humans and equipment.

U.S. Pat. No. 3,889,432 to Geihl discloses a foldable and expandable modular shelter unit for a transportation vehicle. The support of the shelter unit limits it to be used on a vehicle only. U.S. Pat. No. 8,978,318 to Klein teaches an erectable indoor shelter having at least one metal frame attached to internal wall of an apartment. Five protective walls are attached to the frame for forming the shelter.

There is a need to provide a foldable and extendible safe room that can be used indoor as well as outdoor and is totally independent of other supporting structures such as apartments, buildings, or vehicles.

SUMMARY

It is an object to provide an expandable safe room that can be used indoors or outdoors.

It is another object to provide an expandable safe room that is automatically operated.

It is still yet a further object to provide an expandable safe room that is bullet-proof.

It is also a further object to provide an expandable safe room that can be adjusted to provide chemical and biological protection.

It is another object to provide an expandable safe room that is compactly retracted.

It is still yet another object to provide an expandable safe room that can provide protection against sudden intruders provided with cold or hot arms.

It is another object to provide an expandable safe room that can be upgraded with protective panels to increase its ballistic resistance.

It is therefore provided in accordance with preferred embodiment an expandable safe room (ESR) defining a protected space therein, the expandable safe room comprising:

a main upright frame, a pair of side walls hingedly connected to the main upright frame, a front wall parallel to the main upright frame and hingedly connected to the side walls, wherein deploying the ESR in an expanding direction moves the front wall in a forward direction and away from the main upright frame.

In accordance with another preferred embodiment, each of the side walls comprising a side wall front section that is hingedly connected to a side wall rear section.

In accordance with another preferred embodiment, at least one of the side walls or the front wall comprising a door for enabling passage of people into the protected space.

In accordance with another preferred embodiment, the ESR further comprises a roof that is hingedly connected to the main upright frame.

In accordance with another preferred embodiment, the ESR comprises a floor that is hingedly connected to the main upright frame.

In accordance with another preferred embodiment, each of the side walls comprising a side wall front section that is hingedly connected to a side wall rear section.

In accordance with another preferred embodiment, the ESR further comprises a roof that is hingedly connected to the main upright frame by roof hinges and a floor that is hingedly connected to the main upright frame by floor hinges, and wherein each of the side walls comprises a side wall front section that is hingedly connected to a side wall rear section by side hinges.

In accordance with another preferred embodiment, the ESR further comprises a rear wall that is parallel to the main upright frame and fixedly connected thereto.

In accordance with another preferred embodiment, in a folded position of the ESR, the roof, the floor, the front wall, each of the side wall front sections and each of the side wall rear sections are parallel to the rear wall.

In accordance with another preferred embodiment, in a deployed position of the ESR, the front wall is parallel to the rear wall and distanced away therefrom, and wherein each of the side walls is distant from the other side wall, and wherein each side wall front section forms an angle greater than 150° with the adjacent side wall rear section, and the roof is parallel to the floor, distanced away therefrom, and covering a wall upper end of the front wall and of the side walls.

In accordance with another preferred embodiment, deployment of the ESR from a folded position to a deployed position is carried out automatically, semi-automatically, or manually.

In accordance with another preferred embodiment, the ESR is bullet-proof.

In accordance with another preferred embodiment, the front wall and the side wall are provided in an inner portion thereof with magazine rails into which protective panels may be inserted, and wherein the protective panels are capable to withstand higher ballistic threats.

In accordance with another preferred embodiment, the front wall and/or the side walls comprise transparent bullet-proof sections.

In accordance with another preferred embodiment, a thickness dimension of the ESR in a folded position is in a range of 15 cm to 30 cm.

In accordance with another preferred embodiment, the side walls are connected to said main upright frame by arms that are configured to enable the movement of the walls away and/or towards the upright frame.

In accordance with another preferred embodiment, the roof is connected to said main upright frame by pistons configured to enable the rotation of the roof about hinges that connects the roof to the upright frame.

In accordance with another preferred embodiment, the floor is connected to said main upright frame by pistons configured to enable the rotation of the floor about hinges that connects the floor to the upright frame.

In accordance with another preferred embodiment, the ESR further provided with a controller capable of receiving a signal to commence automatic deployment of the ESR in a controlled manner.

In accordance with yet another embodiment, a method is provided wherein the method of deploying the expandable safe room (ESR) from a folded position, comprises:

turning the roof in a rising circular motion around the roof hinges such that an internal angle created between the roof and the rear wall wherein said internal angle is larger than 90°;

turning the floor in a lowering circular motion around the floor hinges until the floor is perpendicular to the rear wall;

moving the front wall in a forward direction and away from the rear wall until the side walls are substantially aligned; and lowering the roof until it abuts against a wall upper end of the front wall and of the side walls.

In accordance with another preferred embodiment, the method is performed automatically and is controlled.

In accordance with another preferred embodiment, during moving the front wall in a forward direction each side wall front section forms an angle greater than 150° with the adjacent side wall rear section.

Unless otherwise defined, all technical and scientific terms used herein have the same meaning as commonly understood by one of ordinary skill in the art to which this embodiment belongs. Although methods and materials similar or equivalent to those described herein can be used in the practice or testing of the embodiments, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF PREFERRED EMBODIMENTS

Figure 1:
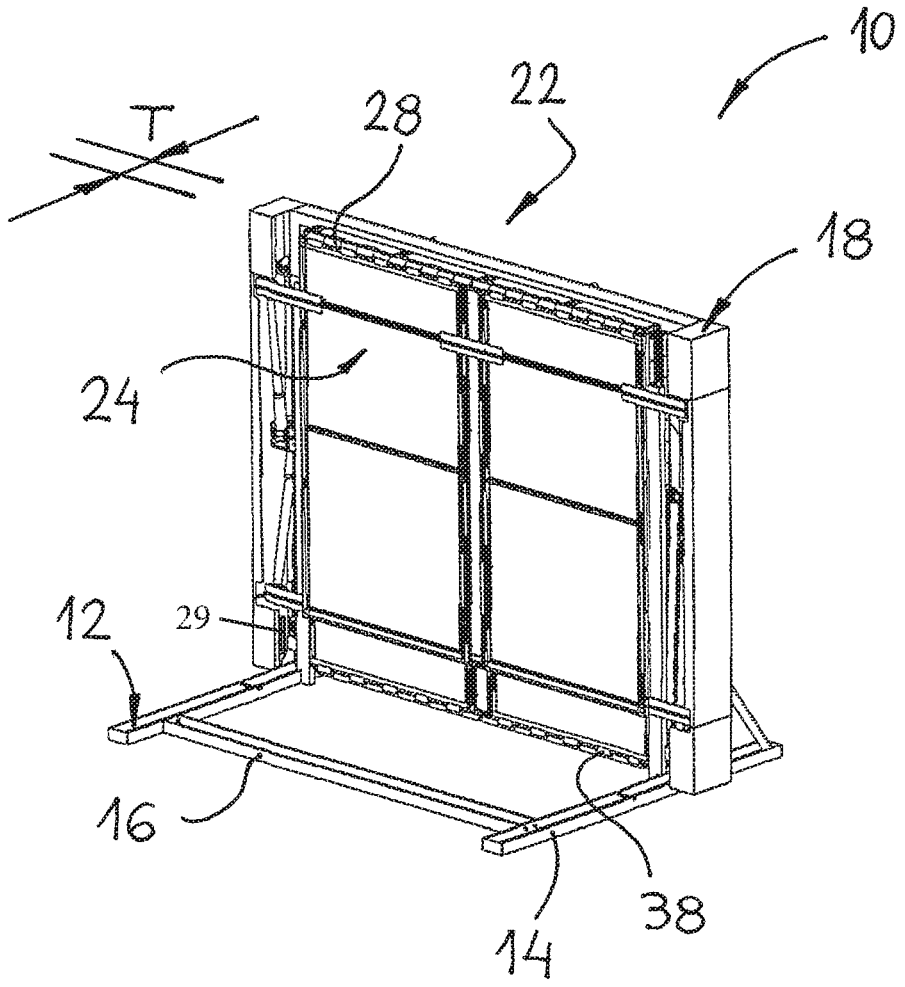
FIG. 1 is a perspective view of an expandable safe room according to a preferred embodiment in a folded position.

Before explaining at least one embodiment in detail, it is to be understood that the embodiments are not limited in its application to the details of construction and the arrangement of the components set forth in the following description or illustrated in the drawings. It is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale. For clarity, non-essential elements were omitted from some of the drawings.

Attention is drawn to FIGS. 1 to 5 that show an expandable safe room in accordance with a preferred embodiment. For a matter of convenience, the expandable safe room will hereinafter be called "ESR".

It should be noted that directional terms appearing throughout the specification and claims, e.g. "forward", "rear", "upper", "lower" etc., are used as terms of convenience to distinguish the location of various surfaces relative to each other. These terms are defined with reference to the figures, however, they are used for illustrative purposes only, and are not intended to limit the scope.

As shown in FIG. 1, an ESR 10 is provided that comprises a frame 12 onto which the various components of the system are mounted and assembled.

A major advantage of the ESR 10 is that in a folded position, as shown in FIG. 1, it has a minimal thickness dimension T thus occupying minimal space in an un-used position, so it may be covered, if desired, with a screening curtain or the like. According to a specific embodiment, in a folded position of the ESR 10, it has a thickness dimension T of about 28 cm. Typically, according to various sizes, uses and needs of the ESR, it has a thickness dimension T of 15 cm to 30 cm. Within the thickness T, almost all the components of the structure are folded; the walls, roof and floor are paralelly positioned within the thickness as well as all the pistons and connectors that facilitate the deployment of the structure.

The ESR 10 is self-standing, i.e., it is not dependable on any wall, bulkhead, frame, vehicle, or the like for maintaining it in an upright position. The frame 12 comprises a pair of lower substantially parallel rails 14 that are connected therebetween by a strengthening beam 16.

A main upright frame 18 having an inverted "U" shape, is vertically connected to the lower rails 14. The main upright frame 18 contains therein the expandable parts of the ESR 10 as will be later described.

A rear wall 20 of the ESR 10 (seen in FIG. 5) is located at a rear side 22 of the ESR 10. The rear wall 20, as well as all other plates forming the ESR 10 are made of steel and are able to withstand ballistic threats up to 7.62 caliber AP according to NIJ IV or Stanag 3. Other materials or combination of materials that can form similar strength of material can be utilized to implement the ESR. Each of the plates forming the ESR 10 is provided, in an inner portion thereof, with magazine rails into which protective panels may be inserted. The protective panels are capable to withstanding higher ballistic threats and are placed and classified according to customer's needs.

Figure 4:
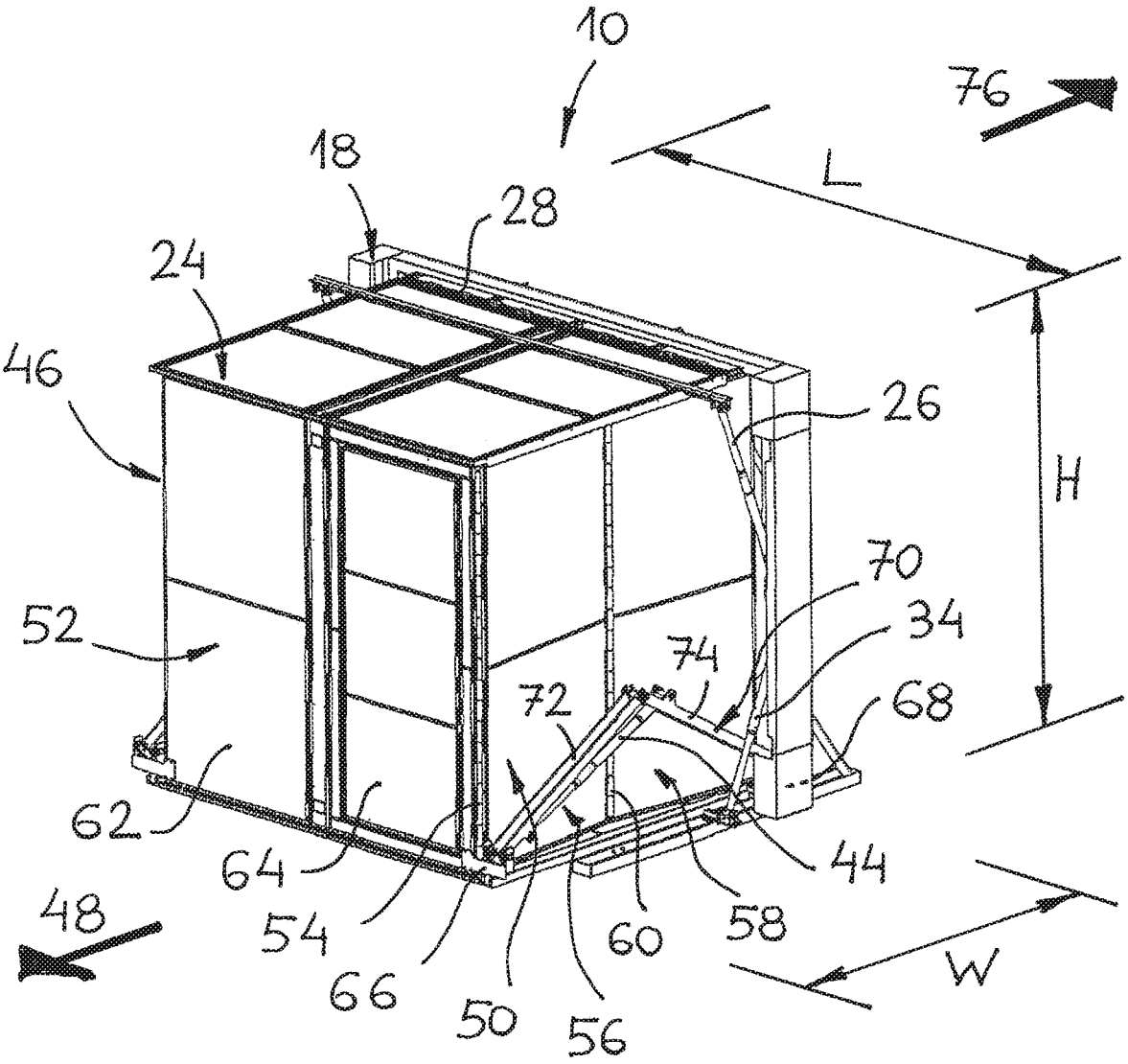
FIG. 4 is a perspective view of the expandable safe room of FIG. 1 with the roof, floor, and walls in an open position.

When it is required to open or deploy the ESR 10 into an operating position, as shown in FIG. 4, an operating system of the ESR 10 is operated. The operating system can be operated automatically, semi-automatically, or manually. In any case, the stages are similar.

In an automatic operation of the ESR 10, a controller 29 of the system optionally receives a signal from an external sensor (not shown in the figures). For example, in a case where it is required to use the ESR 10 as a protective shelter in an area that is susceptible to frequent earthquakes, a seismic sensor can sense that an earthquake is about the burst and signals the controller to immediately open the ESR 10. Thus, in a few seconds, the ESR 10 is open into an operating position and is ready to receive therein the people that have just sensed the earthquake, or, have been warned by the same sensor. The controller 29 can be located in any position on the ESR or in its vicinity, preferably hidden within the frame so no damage may be inflicted on it. It should be noted that the controller can receive communication to start deploying the ESR using a phone line or any other form of wired or wireless communication.

Another example of an automatic operation of the ESR 10 is when it is designed to deploy in a case of fire, in which case it will receive a signal from a fire detection system, or, in a case of burglary into a property, it will receive a signal from the corresponding intruder detector.

According to a specific embodiment, in a deployed position of the ESR 10, it has a length L of 270 cm, measured parallel to the main upright frame 18, a width W of 254 cm, measured perpendicularly to the length dimension L, and, a height H of 216 cm, measured perpendicularly to the length and width dimensions. When using the above described dimensions, the ESR 10 may accommodate therein eighteen people in a case of a need or emergency. Needless to say that other dimension of the ESR is possible according to needs wherein the ESR may accommodate different amounts of people.

A semi-automatically operation of the system means that a person, or a group of people in charge of the operation of the ESR 10, may press an operation button in order to commence deployment of the ESR 10. The operation button may be attached to the ESR 10, mechanically or wired, may be remotely located from the ESR 10, e.g., in other rooms or spaces, or, being operated by a remote controlled system that is not physically wired to the operation system.

A manual operation of the system means that a person manually operates a mechanism that deploys the ESR 10 from a folded position into a deployed position. This may be done, e.g., by rotating an operation handle which in turn operates an opening mechanism of the ESR 10.

Figure 2:
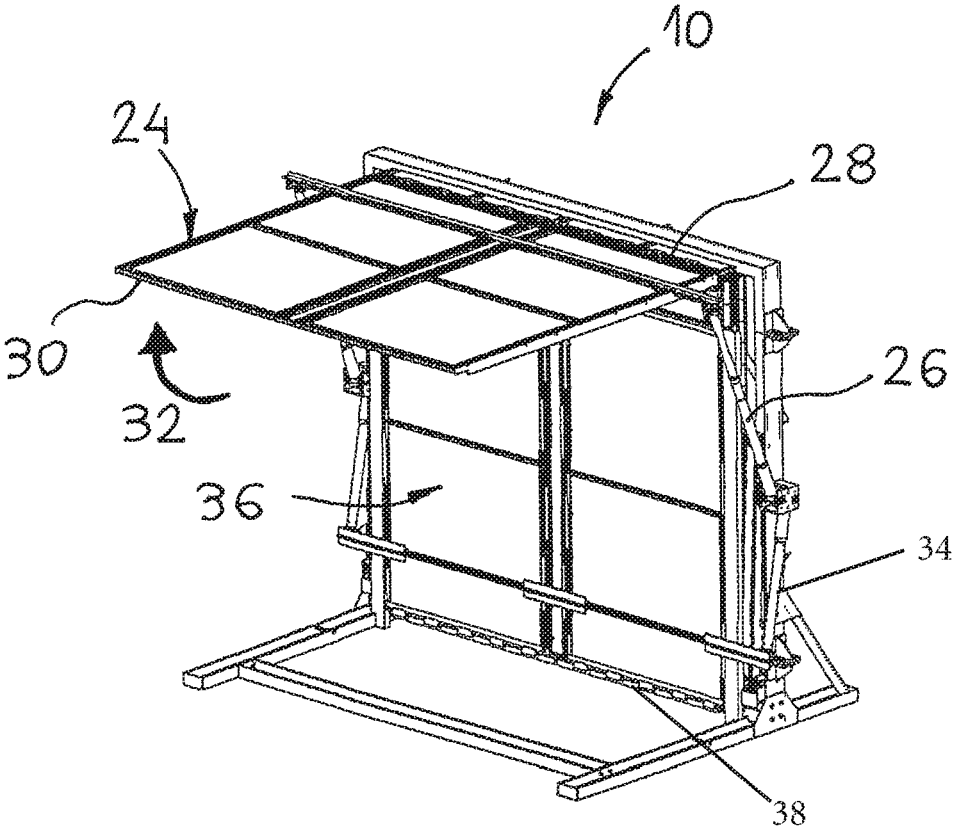
FIG. 2 is a perspective view of the expandable safe room of FIG. 1 with the roof in an open position.
Figure 5:
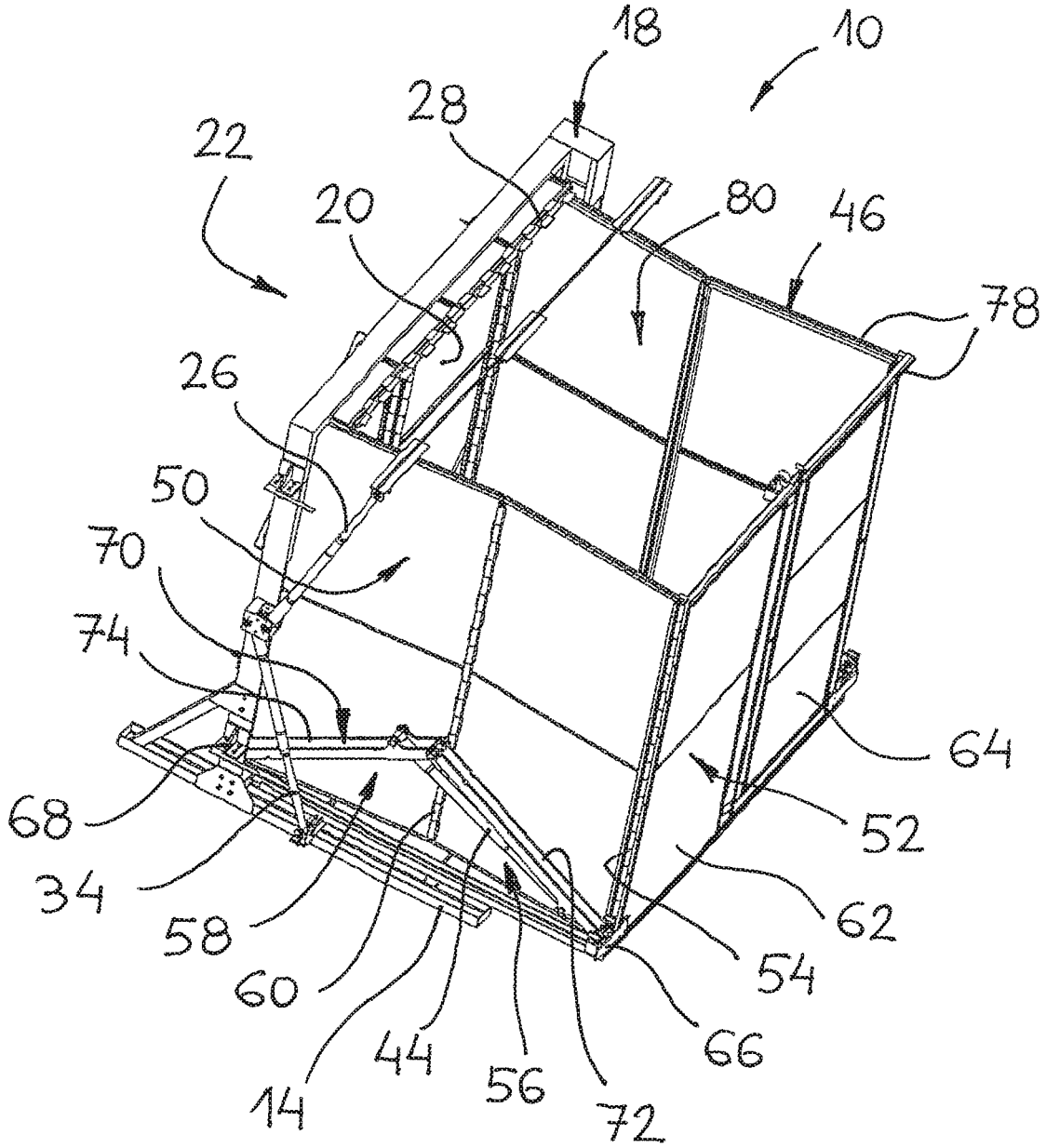
FIG. 5 is a perspective view of the expandable safe room of FIG. 1 with the roof removed and a detailed view of the operating mechanism.

In a first deployment step of the ESR 10, as can be seen in FIG. 2, a roof 24 is elevated to a horizontal positioning by a pair of roof operating pistons 26. The roof 24 is hinged by roof hinges 28 that are attached to the main upright frame 18. Thus, during the deployment of the roof 24, a roof forward end 30 executes a rising circular motion indicated by arrow 32 around the roof hinges 28. It should be mentioned that the roof 24 is elevated slightly above a horizontal positioning of the roof, for a reason that will be later described. In FIGS. 2 and 5, the cover of the upright frame is removed from the figures in order to be able to observe the piston mechanism in full.

According to a specific embodiment, the roof operating pistons 26 are electrical pistons, thereby having their own "positioning sensing system", thus eliminating the need of using additional sensors for sensing the position of the various elements of the system.

When the roof 24 reaches its maximal lifted position, as shown in FIG. 2, the control system 29 (not shown in this figure) receives a signal to commence a second step of deploying the ESR 10. At this step, a pair of floor operating pistons 34 commence deploying a floor 36 that is fully exposed after the deployment of the roof. The floor 36 is hinged by floor hinges 38 that are attached to the main upright frame 18. Thus, during the deployment of the floor 36, a floor forward end 40 executes a lowering circular motion as indicated by an arrow 42 around the floor hinges 38 as shown in FIG. 3.

Figure 3:
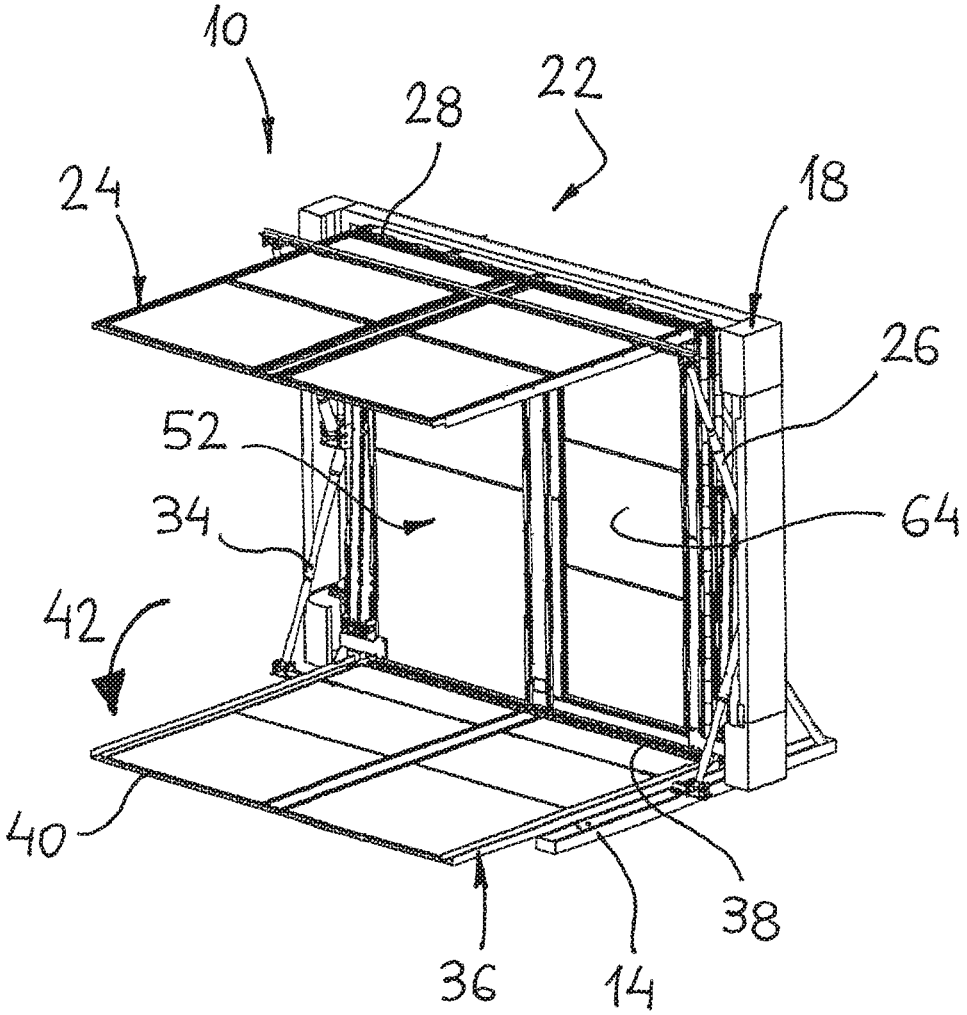
FIG. 3 is a perspective view of the expandable safe room of FIG. 1 with the roof and floor in an open position.

When the floor 36 reaches its final position, i.e., being fully deployed and parallel to the lower rails 14 (as shown in FIG. 3), the floor operating pistons 34 that are preferably also electrical, sense the positioning and signal the control system to commence a third step of deploying the ESR 10. At the end of this step, the removal of the roof and the floor of the frame expose the side walls of the ESR. At the following step as show in FIG. 4, a pair of wall operating pistons 44 opens forwardly in a forward direction indicated by arrow 48 a wall assembly 46. The wall assembly 46 comprises a pair of side walls 50 (only one side can be seen in FIG. 4) and a front wall 52 connected at a wall forward end 54 of the side walls 50.

Each of the side walls 50 comprises two sections, i.e., a side wall front section 56 and a side wall rear section 58 that are handedly connected therebetween by means of a vertically directed side hinge 60. The front wall 52 comprises a fixed portion 62 and a door 64 for enabling the entrance of people into the ESR 10.

In order to assure the forward advancement of the side walls 50 together with the front wall 52 in the proper direction, a lower front end 66 of each side wall front section 56 is connected to a lower rear end 68 of the adjacent side wall rear section 58 by means of an alignment mechanism 70. The alignment mechanism 70 comprises a set of two parallel front arms 72 that are hingedly connected to a set of two parallel rear arms 74. Thus, by means of the two sets of alignment mechanisms 70, oppositely located outward of the side walls 50, it is assured that the side walls 50 and the front wall 52 will move only in the forward direction as indicated by arrow 48, or, when retracted, in a rearward direction as indicated in arrow 76 that is opposite to the forward direction 48.

As mentioned herein before, at the first step, the roof 24 is elevated slightly above the horizontal position. When the front wall 52 and the side walls 50 reach their final position, as shown in FIG. 5 (with the roof removed for clarity), a wall operating piston 44 signals the control system to lower the roof 24 until it abuts against a wall upper end 78 of the front wall 52 and of the side walls 50.

Optionally, in this position, the side wall front section 56 and the side wall rear section 58 are not parallel and not forming a continuity of a straight line, but, forming an obtuse angle with respect to each other, around the side hinge 60 as seen in a top view of the side walls 50. This feature assures that, during a closing operation of the ESR 10, the side wall front section 56 is not locked with respect to the side wall rear section 58 and they can be easily folded with respect to each other, i.e., the obtuse angle therebetween is decreased and the side hinges 60 of the side walls 50 are moving toward each other. Generally, the ESR 10 can be folded in a similar manner as it was deployed. It should be mentioned that the roof has to be slightly elevated before the side and front walls are being folded.

Thus, an ESR such as ESR 10 is easily and efficiently erected, in a quick and safe manner, automatically or manually. Since the ESR 10 has a generally cubic or box shape and it is closed from all six sides thereof, it defines a protected space 80 therein and provides a safe room for people or equipment located therein.

Since the rear wall 20, the roof 24 and the floor 36 form an integral part of the ESR 10, the ESR 10 is very efficient in protecting the people inside also in a case of an earthquake, a missile attack, or even in a case of a total demolition of a building or structure it is located therein.

Optionally, part or all the hinges between the various walls are made such that the adjacent walls are provided with foldable or slidable overlapping parts so that there is no gap between the walls in their open position and they form a continuum of a protective case.

The ESR 10 may be delivered to a site either in an assembled position, as shown in FIG. 1, or, in a dismantled position, in which it is easier and lighter to transport, and then, the various parts are assembled on site.

In some optional embodiments of the ESR 10, the ESR may be provided with transparent elements such as windows of even larger transparent panels across a larger section of the walls. The windows may be ballistic proof and they may be formed from ballistic proof polycarbonate panels, as an example.

The ballistic protection of the ESR provides the people staying therein a wide spectrum of protection against terrorist threats, whether being a protection against fire arms, grenades, mortars blast fragments, or, against cold weapons.

Optionally, in a fire protection mode of the ESR, it is equipped with up to three hours of fire resistant materials that are implemented from the inside of the walls. It is optional that such protection will be implemented also to the roof and to the floor.

In a light-mode of the ESR, it may offer bullet-proof protection and can be installed in buildings, yachts, aircrafts, vehicles such as vans and buses, and the like.

It is a great advantage of the ESR that in a folded position, it has a relatively small thickness dimension; therefore, it can be installed in almost any location, without occupying much room during an unused period. Furthermore, in a folded position, it may be covered with a curtain or the like so it is not seen or noticed at all.

The ESR may be provided in a sealed or ventilated version, and it may also provide a humidity and temperature controlled environment. The ESR may be provided in an insulated or in a non-insulated mode.

Optionally, the ESR can be further provided with biological and chemical filtration systems that can be installed within the inner space of the ESR and include a special tent-style biological and chemical protection bubble or cover. The air filtration system is designed to filter bad odors or polluted air from entering into the protected area.

According to some embodiments, the ESR is provided with observation openings that may be blocked from inside and enable, if needed, outer observation and firing ability.

The control system and the operation system of the ESR are usually powered from the mains. However, as is the case of emergency, sometimes the mains power is not available. For that reason, some embodiments of the ESR are provided with a remotely starting generator and with an emergency battery supply voltage.

Although the present disclosure has been described to a certain degree of particularity, it should be understood that various alterations and modifications could be made without departing from the spirit or scope of the disclosure as hereinafter claimed. For example, the side wall front section does not have to form an obtuse angle with the side wall rear section, and they may form a straight angle therebetween. It that case, the side walls are further provided with a lock-breaking-device, to "break" the straight angle into an obtuse angle for enabling folding the side wall front sections with respect to their corresponding side wall rear sections.

The ESR is not limited to the sizes described above and other dimensions of the ESR may be equally applicable to suit different needs and different accommodation of people. Furthermore, the ESR can be installed indoors as well as outdoors.

The ESR does not have to be operated by electrical pistons and other drive means may be equally applicable as well. For example, the operation of the various parts of the ESR may be through hydraulic or pneumatic pistons, or, it may be carried out by various mechanical driving mechanisms like gears, winches and cables, and the like.

The ESR is not limited to have its side walls having only two sections as described above. Alternatively, the side walls may contain higher number of sections, such as four or more. Typically, it is advantageous that the number of sections of the side walls be a pair number, thereby enabling easy opening and easy folding of the side walls as described above. In a case where the number of sections of the side walls is higher, then, it requires that the roof and the floor have a significantly larger width dimension. This may be achieved if the space available provides enough height for the ESR.

According to other embodiments, instead of producing the ESR with a very large height, the roof and the floor are also made of a multitude of sections that unfold as necessary.

The ESR is not limited to provide closing from six sides. At some embodiments, where the risk of earthquake is small, and where the floor and the roof of the building are made from a reinforced steel beams concrete, the ESR may be provided with a protection from four sides only which comprise the walls of the ESR. Furthermore, in a case where also a rear wall of the erection site of the ESR is made of solid reinforced concrete, the ESR may be provided with a protection of three walls only, i.e., the side walls and the front wall.

It is appreciated that certain features of the embodiments, which are, for clarity, described in the context of separate embodiments, may also be provided in combination in a single embodiment. Conversely, various features of the embodiments, which are, for brevity, described in the context of a single embodiment, may also be provided separately or in any suitable sub combination.

Although described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A bullet proof, fully automatically expandable safe room (ESR) defining a protected space therein, the ESR comprising:

a self-standing main upright frame having a front surface and a rear surface and configured to contain expandable and movable parts when in a folded position wherein the upright frame comprises a pair of lower substantially parallel rails for supporting the upright frame;

a controller configured to automatically expand and retract the ESR from either the folded position to a deployed position or vice-versa, respectively;

a rear wall fixedly connected within the main upright frame wherein the rear wall defines the rear surface;

the expandable and movable parts comprising:

a pair of side walls hingedly connected to the main upright frame; and a front wall parallel to the main upright frame and hingedly connected to the side walls, wherein an alignment mechanism assures that the side walls and the front wall will move only in a forward or rearward direction;

a roof hingedly connected to the main upright frame;

a floor hingedly connected to the main upright frame, wherein the floor in a fully deployed position is substantially parallel to the rails; and a plurality of powered pistons selected from the group consisting of hydraulic pistons, pneumatic pistons, electrical pistons, and any combination thereof that are capable of expanding and retracting the ESR, wherein the pistons are capable of being sequentially activated by the controller, wherein the side walls, the front wall, the roof, and the floor are made of materials that are able to withstand ballistic threats up to substantially 7.62 caliber AP, and wherein a thickness dimension from the front surface that is defined by the front wall to the rear surface of the upright frame of the ESR in a folded position is in a range of 15 cm to 30 cm.

2. The ESR according to claim 1, wherein each of the side walls comprises a side wall front section that is hingedly connected by a vertically connected side hinge to a side wall rear section.

3. The ESR according to claim 1, wherein at least one of the side walls or the front wall comprises a door for enabling passage of people into the protected space.

4. The ESR according to claim 1, wherein the roof is hingedly connected to the main upright frame by roof hinges and the floor is hingedly connected to the main upright frame by floor hinges, and wherein each of the side walls comprises a side wall front section that is hingedly connected to a side wall rear section by side hinges.

5. The ESR according to claim 1, wherein the rear wall is parallel to the main upright frame.

6. The ESR according to claim 2, wherein in the folded position of the ESR, the roof, the floor, the front wall, each of the side wall front sections and each of the side wall rear sections are parallel to the rear wall.

7. The ESR according to claim 2, wherein in a deployed position of the ESR, the front wall is parallel to the rear wall and distanced away therefrom, and wherein each of the side walls is distant from the other side wall, and wherein each side wall front section forms an angle greater than 150° with the adjacent side wall rear section, and the roof is parallel to the floor, distanced away therefrom, and covering a wall upper end of the front wall and of the side walls.

8. The ESR according to claim 1, wherein the front wall and the side wall are provided in an inner portion thereof with magazine rails into which protective panels may be inserted, and wherein the protective panels are capable of withstanding higher ballistic threats.

9. The ESR according to claim 1, wherein the front wall and/or the side walls comprise transparent bullet-proof sections.

10. The ESR according to claim 1, wherein the alignment mechanism comprises arms that are configured to enable the movement of the walls away and/or towards the upright frame.

11. The ESR according to claim 1, wherein the roof is connected to said main upright frame by pistons configured to enable the rotation of the roof about hinges that connect the roof to the upright frame.

12. The ESR according to claim 1, wherein the floor is connected to said main upright frame by pistons configured to enable the rotation of the floor about hinges that connect the floor to the upright frame.

13. The ESR according to claim 1, wherein the controller is capable of receiving a signal to commence automatic deployment of the ESR in a controlled manner.

14. A method of automatically deploying the ESR of claim 6 from the folded position to a deployed position, the method comprising:

acquiring a sensor-initiated signal that triggers the controller to deploy the ESR;

activating at least one piston of the plurality of pistons that are associated with the roof for turning the roof in a rising circular motion around the roof hinges such that an internal angle is created between the roof and the rear wall wherein said internal angle is larger than 90°;

activating at least one piston of the plurality of pistons that are associated with the floor for turning the floor in a lowering circular motion around the floor hinges until the floor is perpendicular to the rear wall and parallel to the rails;

activating at least one piston of the plurality of pistons that are associated with the front wall for moving the front wall in a forward direction and away from the rear wall until the side walls are substantially aligned; and activating at least one piston of the plurality of pistons that are associated with the roof for lowering the roof until it abuts a wall upper end of the front wall and of the side walls.

15. The method of claim 14, further comprising activating the controller to fold the ESR from the deployed position to the folded position in a reverse sequence.

16. A bullet proof, fully automatically expandable safe room (ESR) defining a protected space therein, the ESR comprising:

a self-standing main upright frame having a front surface and a rear surface, having two oppositely positioned vertical supports, and configured to contain expandable and movable parts when in a folded position wherein the upright frame comprises a pair of lower substantially parallel rails for supporting the upright frame;

a controller configured to automatically expand and retract the ESR from either the folded position to a deployed position or vice-versa, respectively;

a rear wall positioned within the vertical supports and fixedly connected within the main upright frame to form a rear surface of the main upright frame;

expandable and movable parts comprising:

a pair of side walls each hingedly connected to a vertical support of the main upright frame; and a front wall parallel to the main upright frame and hingedly connected to the side walls, wherein an alignment mechanism assures that the side walls and the front wall will move only in a forward or rearward direction;

a roof hingedly connected to a horizontal upper member of the main upright frame; and a floor hingedly connected to a horizontal lower member of the main upright frame, wherein the floor in a fully deployed position is substantially parallel to the rails; and a plurality of powered pistons selected from the group consisting of hydraulic pistons, pneumatic pistons, electrical pistons, and any combination thereof that are capable of moving the side walls, the front wall, the roof, and the floor to expand or retract the ESR, wherein the pistons are capable of being sequentially activated by the controller, wherein the side walls, the front wall, the roof, and the floor are made of materials that are able to withstand ballistic threats up to substantially 7.62 caliber AP, and wherein a thickness dimension from the front surface to the rear surface of the upright frame of the ESR in a folded position is in a range of 15 cm to 30 cm.

* * * * *